US005185520A

United States Patent [19]

Kurata

[11] Patent Number: 5,185,520

[45] Date of Patent: Feb. 9, 1993

[54] SHEET OVERLAPPING DETECTING METHOD

[75] Inventor: Yoshiaki Kurata, Ibaraki, Japan

[73] Assignee: Komori Corporation, Tokyo, Japan

[21] Appl. No.: 538,023

[22] Filed: Jun. 13, 1990

[30] Foreign Application Priority Data

Jun. 19, 1989 [JP] Japan ..... 1-154710

[51] Int. Cl.[5] ..... G01N 9/04

[52] U.S. Cl. ..... 250/223 R; 250/214 R

[58] Field of Search ..... 250/561, 223 R, 214 R, 250/214 RC, 560, 208.2; 226/45

[56] References Cited

U.S. PATENT DOCUMENTS 4,286,149 8/1981 Ben-Nathan ..... 250/223 R

*Primary Examiner*—David C. Nelms

*Attorney, Agent, or Firm*—Remy J. VanOphem

[57] ABSTRACT

A sheet overlapping detecting method includes the following steps. A predetermined level value $V_{os}$ is set as the level of a light emission signal. On the basis of a value $V_{ik}$ of a light reception signal obtained upon light reception based on light emission corresponding to a light emission signal having a predetermined level value $V_{os}$, an optimum value $V_{od}$ corresponding to the input value $V_k$ is calculated in accordance with a prestored $V_{ik}-V_{od}$ characteristic table. The calculated optimum value $V_{od}$ is set as the level of the light emission signal to drive the light-emitting device. On the basis of a value $V_{ik}$ of a corresponding light reception signal, a change value $V_{1\text{-}2}$ corresponding to the input value $V_{ik}$ is calculated in accordance with a prestored $V_{ik}-V_{1\text{-}2}$ chararcteristic table. A determination level $V_L$ is calculated in accordance with the following equation:

$$V_L = V_1 - (V_{1\text{-}2})^{\frac{1}{2}}$$

where $V_1$ is the value of a light reception signal obtained when the optimum value $V_{od}$ is set as the level of a light emission signal. Overlapping of sheets to be fed is detected in accordance with the calculated determination level $V_L$.

5 Claims, 5 Drawing Sheets

SHEET OVERLAPPING DETECTING METHOD

BACKGROUND OF THE INVENTION

The present invention relates to a sheet overlapping detecting method for use particularly in a sheet-fed press.

Conventionally, when sheets (sheets of paper) are to be fed to a sheet-fed press, overlapping of the sheets of paper to be fed is detected.

That is, when a sheet of paper is to be fed from a feeding apparatus to a sheet-fed press (to be referred to as simply a press hereinafter), the leading edge of the sheet of paper is brought into contact with a stopper called a front guide provided at the press-side distal end portion of a feeding table, and then the sheet of paper is fed to the press. In this case, in order to prevent two or more overlapped sheets of paper from being simultaneously fed, a light-emitting device is arranged at the rear surface side of the feeding table in a position close to the front guide, and a through hole is formed in a predetermined portion of the feeding table corresponding to a light-emitting portion of the light-emitting device. In addition, a light-receiving device is arranged at the upper surface side of the feeding table corresponding to the through hole. That is, light emitted from the light-emitting device is radiated in the direction of thickness of a sheet of paper to be fed, and transmission light transmitted through the sheet of paper is received by the light-receiving device and converted into an electrical signal to obtain a received light amount. An output level corresponding to the received light amount is compared with a predetermined determination level, and overlapping of sheets of paper is detected on the basis of the comparison result.

In this case, a light emission amount of light emitted from the light-emitting device and the determination level are preferably set to be optimum values for a corresponding sheet of paper. That is, the relationship between the light emission amount and the output level obtained when the number of sheets of paper is one is different from that obtained when the the number of sheets of paper is two. For example, as shown in FIG. 5, a characteristic curve I is obtained for one sheet of paper, and a characteristic curve II is obtained for two sheets of paper. In this case, the optimum value of the light emission amount is a light emission amount value at which a difference between output levels based on the characteristic curves I and II becomes maximum. The optimum value of the determination level is ½ a sum of the output levels based on the characteristic curves I and II obtained at the optimum light emission amount value.

According to a first conventional method, a predetermined determination level is set, and power supply to the light-emitting device is adjusted such that the determination level is positioned at a substantially intermediate point between an output level obtained via the light-receiving device when the number of sheets of paper is one and an output level obtained when the number of sheets of paper is two, thereby setting a light emission amount of light to be emitted from the light-emitting device. According to a second conventional method, predetermined power supply to the light-emitting device is set to determine a light emission amount of light to be emitted from the light-emitting device, and a determination level is set to be positioned at a substantially intermediate point between an output level obtained via the light-receiving device when the number of sheets of paper is one and an output level obtained when the number of sheets of paper is two.

In general, however, a small number of lots of a material is often printed by a press using various types of sheets of paper. That is, since the characteristic curves I and II shown in FIG. 5 change in accordance with the paper quality (including paper thickness, a color, and the like) of paper to be used, the optimum values of a light emission amount and a determination level cannot be kept constant. Therefore, in the above first and second methods, it is difficult to perform stable overlapping detection with high precision for sheets of paper having a wide range of paper quality. In addition, adjustment of the optimum values undesirably largely depends on the skills of an operator.

In addition, in the conventional methods, overlapping of sheets of paper is detected by using a pair of light-emitting and light-receiving devices. Therefore, overlapping detection for sheets of paper having an extremely unstable fiber density (i.e., hungry sheets) is limited by using only the above methods to cause an erroneous operation. For this reason, when overlapping detection is not stably performed, an operator must stop the overlapping detecting function and perform visual inspection, resulting in large physical and mental burdens on the operator.

SUMMARY OF THE INVENTION

It is, therefore, a first object of the present invention to provide a sheet overlapping detecting method which can perform stable overlapping detection of sheets with high precision and can perform adjustment without depending on the skills of an operator.

It is a second object of the present invention to provide a sheet overlapping detecting method which can perform stable overlapping detection for hungry sheets.

According to a first aspect of the present invention, there is provided a sheet overlapping detecting method in which light-emitting means is driven in accordance with a light emission signal having a control level $V_{out}$ output from a data processing unit, light emitted from the light-emitting means is radiated in a direction of thickness of a sheet to be fed, light transmitted through the sheet to be fed is received by light-receiving means, a light reception signal having an output level $V_{in}$ corresponding to a received light amount of the light-receiving means is input to the data processing unit, and overlapping of sheets to be fed is detected on the basis of the light reception signal. The method includes the steps of setting a predetermined level value $V_{os}$ as the level of the light emission signal, and calculating, on the basis of a value $V_{ik}$ of a light reception signal obtained upon light reception based on light emission corresponding to the light emission signal having the predetermined level value $V_{os}$, an optimum value $V_{od}$ corresponding to the input value $V_{ik}$ in accordance with a $V_{ik}-V_{od}$ characteristic table stored beforehand and representing a relationship between the value $V_{ik}$ as paper quality data and the optimum value $V_{od}$ of the light emission signal, setting the calculated optimum value $V_{od}$ as the level of the light emission signal to drive the light-emitting device, and calculating, on the basis of a value $V_{ik}$ of a corresponding light reception signal, a change value $V_{-2}$ corresponding to the input value $V_{ik}$ in accordance with a $V_{ik}-V_{1-2}$ characteristic table stored beforehand and representing a relationship between the value $V_{ik}$ as the paper quality data and a level change value $V_{1-2}$ of the light reception signal caused by overlapping of sheets to be fed when the optimum value $V_{od}$ is set as the level of the light emission signal, calculating a determination level $V_L$ in accordance with the following equation:

$$V_L = V_1 - (V_{1-2})\tfrac{1}{2}$$

where $V_1$ is the value of a light reception signal obtained when the optimum value $V_{od}$ is set as the level of a light emission signal, and detecting overlapping of sheets to be fed in accordance with the calculated determination level $V_L$.

According to a second aspect of the present invention, there is provided a sheet overlapping detecting method including the steps of radiating light emitted from first and second light-emitting means in a direction of thickness of a sheet to be fed, receiving light transmitted through the sheet to be fed by first and second light-receiving means, calculating a level difference between first and second output levels corresponding to received light amounts, and comparing the calculated level difference with a predetermined value, calculating a sum of the first and second output levels if the level difference is equal to or smaller than the predetermined value and setting a ½ value of the sum as effective data to be determined, setting a level value of a larger one of the first and second output levels as the effective data to be determined if the level difference is larger than the predetermined value, and comparing the effective data to be determined with a predetermined determination level, and detecting overlapping of sheets to be fed on the basis of the comparison result.

According to a third aspect of the present invention, there is provided a sheet overlapping detecting method including the steps of radiating light emitted from first to Nth light-emitting means in a direction of thickness of a sheet to be fed, causing first to Nth light-receiving means to receive light transmitted through the sheet to be fed, setting an average of output levels, of first to Nth output levels corresponding to received light amounts, having differences with respect to a maximum level equal to or smaller than a predetermined value as effective data to be determined, comparing a predetermined determination level with the effective data to be determined, and detecting overlapping of sheets to be fed on the basis of the comparison result.

DETAILED DESCRIPTION OF THE PREFERRED EMBODIMENT

A sheet overlapping detecting method according the present invention will be described in detail below.

Figure 1:
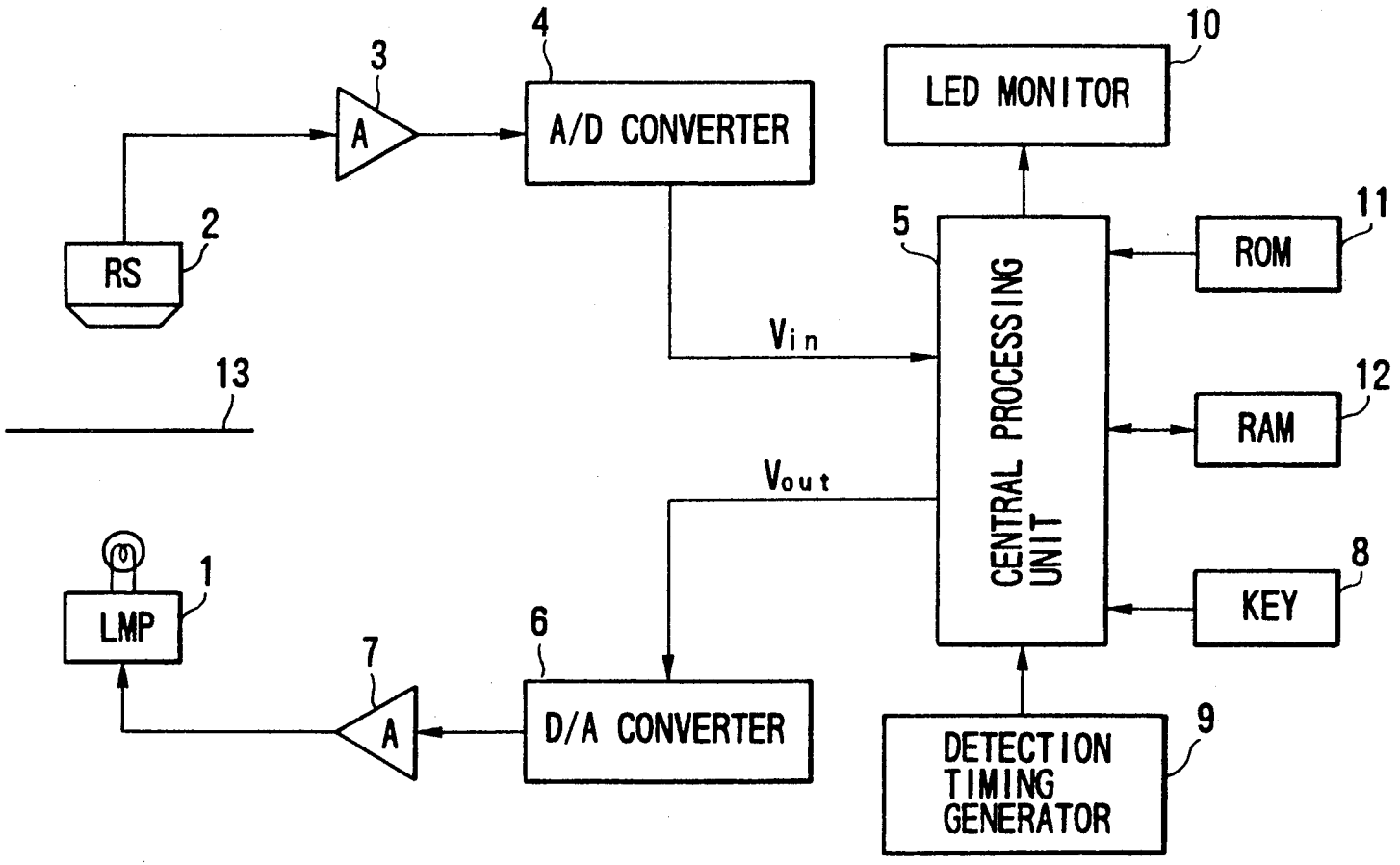
FIG. 1 is a block diagram showing an arrangement of an apparatus according to a first embodiment of the present invention.

FIG. 1 shows an arrangement of an apparatus according to a first embodiment of the present invention. Referring to FIG. 1, reference numeral 1 denotes a light-emitting device; 2, a light-receiving device; 3, an amplifier for amplifying an output electrical signal (analog signal) corresponding to a received light amount supplied from the light-receiving device 2; 4, an A/D converter for converting the amplified electrical signal supplied from the amplifier 3 into a digital signal and supplying the digital signal as a light reception signal having an output level $V_{in}$ to a microprocessor (to be referred to as a CPU hereinafter) 5; 6, a D/A converter for converting a light emission signal having a control level (digital signal) $V_{out}$ output from the CPU 5 into an analog signal; 7, an amplifier for amplifying the analog signal output from the D/A converter 6 to obtain a power signal and supplying the power signal to the light-emitting device 1; and 13, a sheet of paper to be printed.

The CPU 5 is connected to keys 8 for inputting a command by an operator, a detection timing generator 9 for generating a sheet detection timing, and a monitor 10 for acknowledging processing information of the CPU 5 to an operator. A central processing system is constituted by the CPU 5, a ROM 11 for storing programs for operating the CPU 5 and characteristic tables to be described later, and a RAM 12 for storing/editing various types of information.

The light-emitting device 1 and the light-receiving device 2 are arranged to oppose each other with a front guide of a feeding table of a press (not shown) therebetween as described above in the explanation of the conventional apparatus. The amplification factors (gains) of the amplifiers 3 and 7 can be arbitrarily adjusted.

Figure 2:
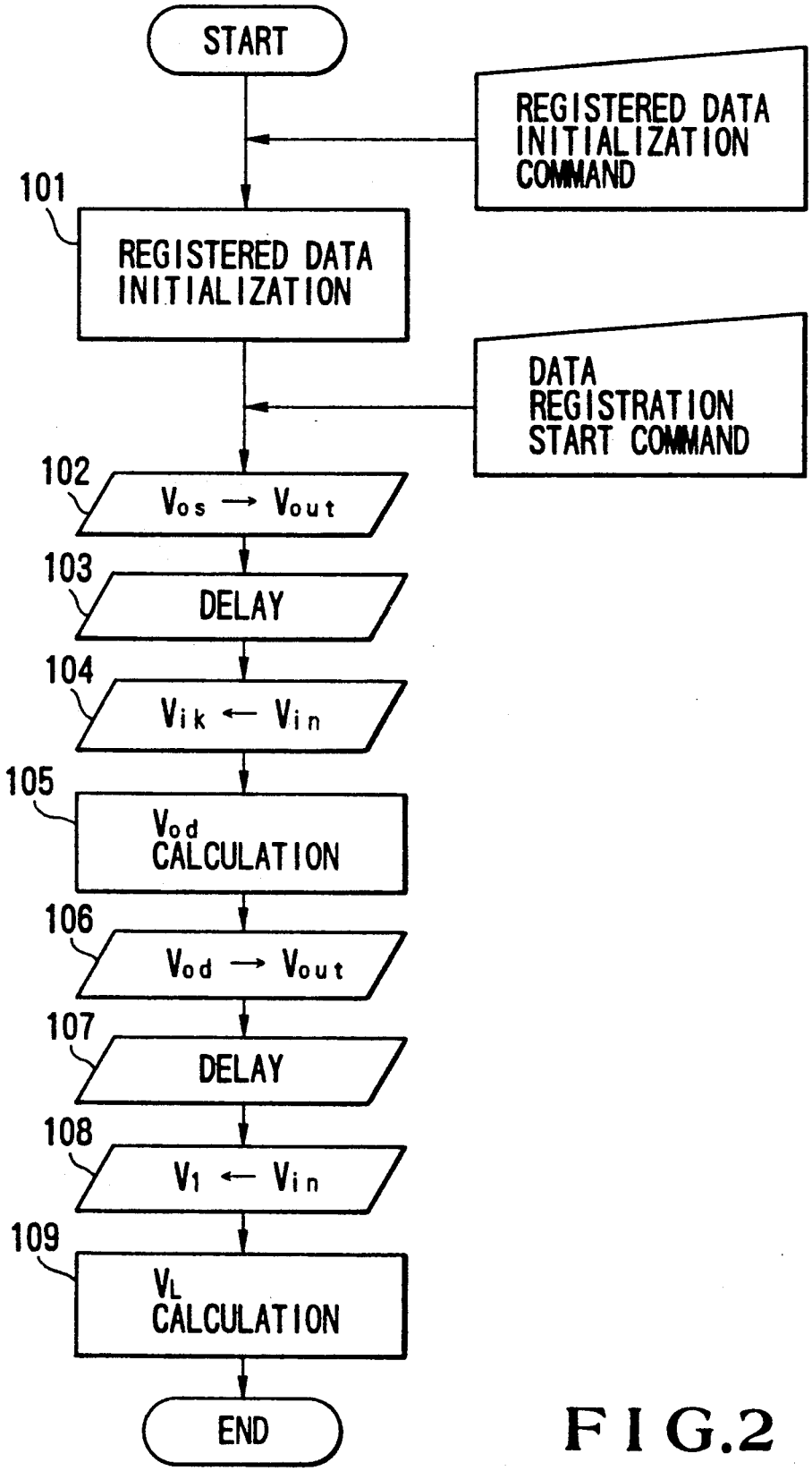
FIG. 2 is a flow chart for explaining data registration processing executed by a CPU of the apparatus shown in FIG. 1.
Figure 3:
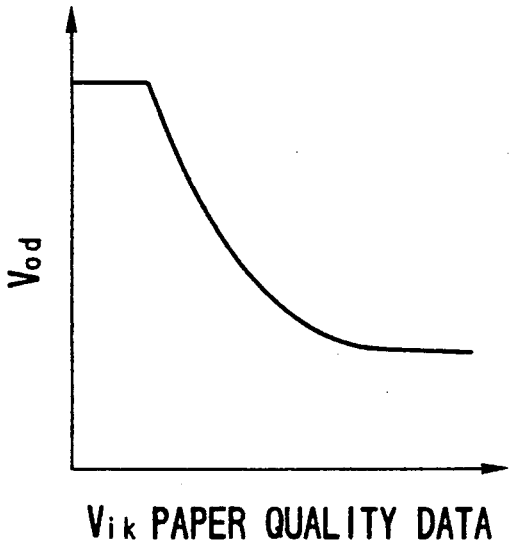
FIG. 3 is a graph showing an optimum value $V_{od}$ of a control level $V_{out}$ experimentally obtained by using a value $V_{ik}$ as paper quality data.

FIG. 2 is a flow chart for explaining data registration processing to be executed by the CPU 5. The processing will be described below with reference to the inputs an initial command of sheet overlapping detection processing, i.e., a "registered data initialization command" via the keys 8, the CPU 5 initializes data registered so far (step 101). When an operator feeds one sheet of paper to the front guide, i.e., conveys the sheet 13 between the light-emitting device 1 and the light-receiving device 2 and inputs a "data registration start command" via the keys 8, the CPU 5 sets a control level $V_{out}$ of a light emission signal as a predetermined level value $V_{os}$ (step 102). As a result, the light-emitting device 1 emits light in a light emission amount corresponding to the predetermined level value $V_{os}$. Thereafter, the CPU 5 calculates a time required before the light emission amount of the light emitted by the light-emitting device 1 is stabilized, waits until the calculated time elapses (step 103), and fetches a light reception signal having an output level $V_{in}$ corresponding to a received light amount of the light-receiving device 2 from the A/D converter 4 (step 104). A value $V_{ik}$ of the fetched output level $V_{in}$ is data indicating the paper quality of the sheet 13. The value $V_{ik}$ and an optimum value $V_{od}$ of the control level $V_{out}$ for maintaining the optimum value of the light emission amount with respect to the sheet 13 have a predetermined relationship. FIG. 3 is a graph showing a characteristic curve of the optimum value $V_{od}$ of the control level $V_{out}$ experimentally obtained by using the value $V_{ik}$ as paper quality data (i.e., a $V_{ik}-V_{od}$ characteristic table). This $V_{ik}-V_{od}$ characteristic table is stored in the ROM 11, and the CPU 5 obtains and registers the optimum value $V_{od}$ of the control level $V_{out}$ corresponding to the fetched value $V_{ik}$ in accordance with the stored $V_{ik}-V_{od}$ characteristic table (step 105).

Figure 4:
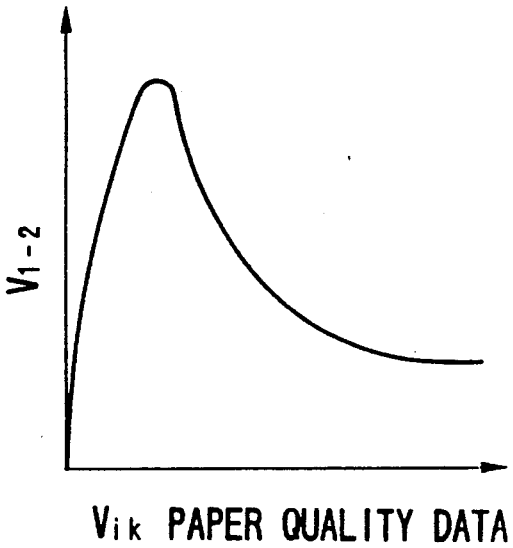
FIG. 4 is a graph showing a change value $V_{1-2}$ of an output level $V_{in}$ experimentally obtained by using the value $V_{ik}$ as paper quality data.

The CPU 5 sets the registered optimum value $V_{od}$ as the control level $V_{out}$ (step 106) to change the light emission amount of the light emitted from the light-emitting device 1. Thereafter, the CPU 5 calculates a time required before the light emission amount of the light emitted from the light-emitting device 1 is stabilized, waits until the calculated time elapses (step 107), and fetches the output level $V_{in}$ corresponding to the received light amount of the light-receiving device 2 (step 108). A value $V_1$ of the fetched output level $V_{in}$ is obtained as the output level $V_{in}$ with respect to one sheet 13 obtained when the optimum value $V_{od}$ is set as the control level $V_{out}$. In this case, the value $V_{ik}$ obtained in step 104 and a change value $V_{1-2}$ of the output level $V_{in}$ (a difference between the output levels $V_{in}$ obtained for one sheet and two sheets) which changes in accordance with overlapping (two-sheet overlapping) of the sheets 13 when the optimum value $V_{od}$ is set as the control level $V_{out}$ have a predetermined relationship. FIG. 4 is a graph showing a characteristic curve of the change value $V_{1-2}$ of the output level $V_{in}$ experimentally obtained by using the value $V_{ik}$ as paper quality data (i.e., a $V_{ik}-V_{1-2}$ characteristic table). This $V_{ik}-V_{1-2}$ characteristic table is stored in the ROM 11, and the CPU 5 obtains the change value $V_{1-2}$ corresponding to the value $V_{ik}$ obtained in step 104 in accordance with the stored $V_{ik}-V_{1-2}$ characteristic table and obtains and registers a determination level $V_L$ by the following relation (step 109):

$$V_L=V_1-(V_{1-2})\tfrac{1}{2}$$

The optimum light emission amount and the optimum determination level with respect to the sheet 13 are determined by the above processing. By repetitively performing the above processing each time the paper quality of sheets of paper changes, the optimum light emission amount and the optimum determination level can be determined for sheets of paper having a wide range of paper quality to realize stable sheet overlapping detection with high precision. In addition, the optimum value $V_{od}$ of the control level $V_{out}$ is obtained in accordance with the $V_{ik}-V_{od}$ characteristic table, and the change value $V_{1-2}$ is obtained in accordance with the $V_{ik}-V_{1-2}$ characteristic table. Therefore, since the optimum light emission amount and the optimum determination level can be adjusted without depending on the skills of an operator, an adjustment operation can be largely simplified.

In the above description, the "data registration start command" is supplied to the CPU 5 via the keys 8. However, the "data registration start command" can be automatically supplied at a predetermined timing from the detection timing generator 9 during an operation of the press. In this case, since a sheet need not be manually conveyed to the front guide and the "data registration start command" need not be supplied via the keys 8, an operator need only input the "registered data initialization command", if necessary.

In mass-production, a variation in characteristics of the light-emitting device 1 and the light-receiving device 2 between individual products is a problem. That is, a relationship obtained by the light-emitting device 1 and the light-receiving device 2 which are actually used is sometimes largely shifted from the relationships shown in FIGS. 3 and 4, and this is a large unstable factor in mass-production. Therefore, in order to maintain the relationship obtained by the light-emitting device 1 and the light-receiving device 2 constant, the system of the present invention additionally has a correction function (to be referred to as an ADJ function hereinafter). That is, when an operator inputs an "ADJ function start command" via the keys 8, the CPU shifts an operation mode from a normal overlapping detection mode to an ADJ function mode. In this ADJ function mode, the CPU 5 sets the predetermined level value $V_{os}$ as the control level $V_{out}$ and fetches the output level $V_{in}$ at a predetermined interval. The CPU 5 causes the monitor 10 to display information indicating whether the fetched output level $V_{in}$ falls within a predetermined range or is higher or lower than the range. Since an operator adjusts the gains of the amplifiers 3 and 7 while monitoring the displayed value, the relationship obtained by the light-emitting device 1 and the light-receiving device 2 can be easily corrected to be constant, and overlapping detection can be performed more stably by this correction. Note that this adjustment need only be performed once upon installation of the apparatus.

The second embodiment of the present invention, which can reduce an influence of hungry sheets of paper, will be described below with reference to FIGS. 6 and 7.

Figure 6:
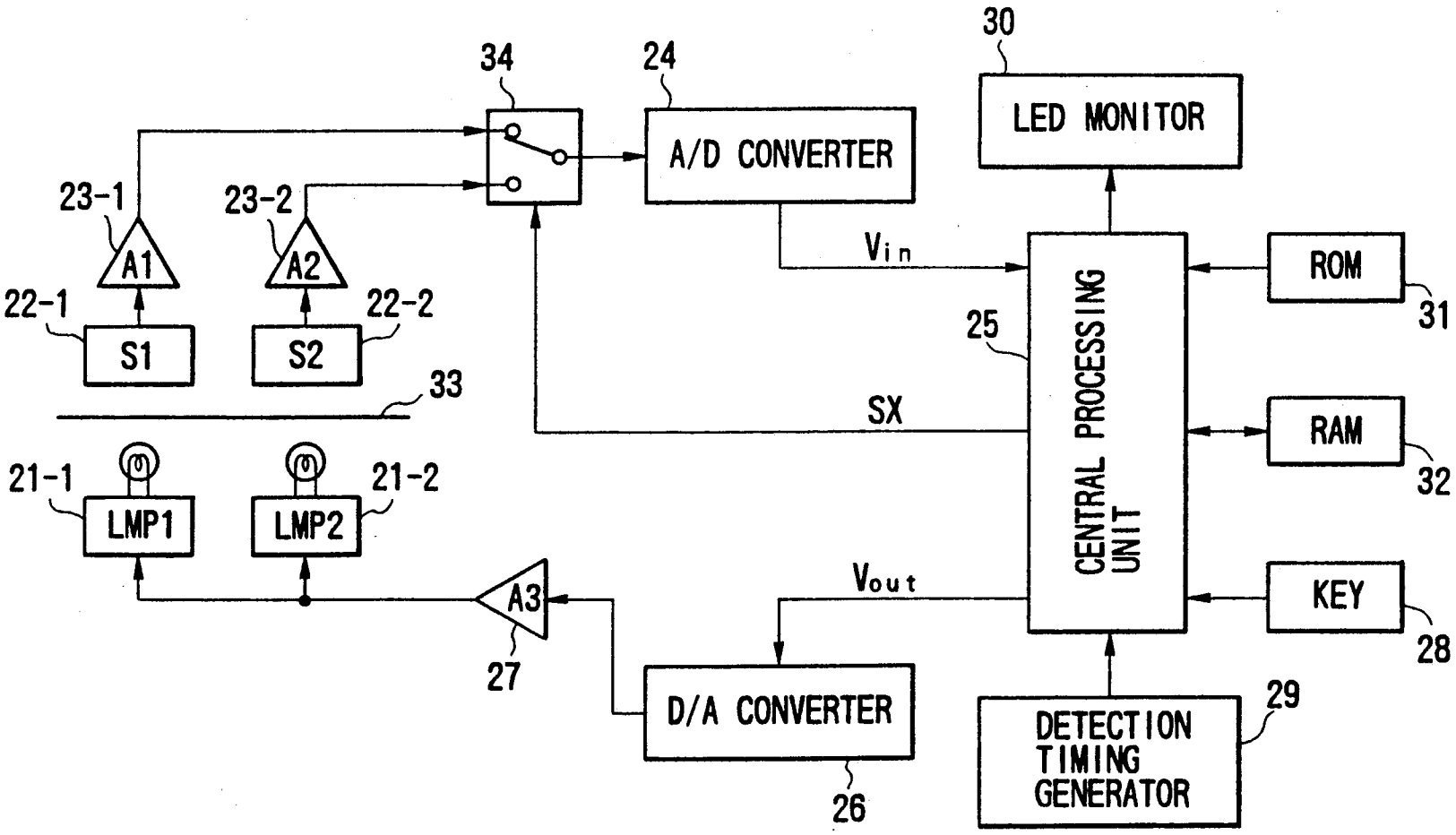
FIG. 6 is a block diagram showing an arrangement of an apparatus according to the second embodiment of the present invention.

FIG. 6 shows an arrangement of an apparatus according to the second embodiment of the present invention. Referring to FIG. 6, reference numerals 21-1 and 21-2 denote light-emitting devices; 22-1 and 22-2, light-receiving devices; 23-1 and 23-2, amplifiers for amplifying output electrical signals (analog signals) corresponding to received light amounts supplied from the light-receiving devices 22-1 and 22-2, respectively; 34, a multiplexer for selecting the amplified electrical signals supplied via the amplifiers 23-1 and 23-2 on the basis of a command (switching signal SX) from a microprocessor (to be referred to as a CPU hereinafter) 25; 24, an A/D converter for converting the amplified electrical signal selected by the multiplexer 34 into a digital signal and supplying the digital signal as a light reception signal of an output level $V_{in}$ to the CPU 25; 26, a D/A converter for converting a light emission signal having a control level (digital signal) $V_{out}$ output from the CPU 25 into an analog signal; and 27, an amplifier for amplifying the analog signal output from the D/A converter 26 and supplying the amplified signal to the light-emitting devices 21-1 and 21-2.

The CPU 25 is connected to keys 28 for inputting a command from an operator, a detection timing generator 29 for generating a sheet detection timing, and a monitor 30 for acknowledging processing information of the CPU 25 to an operator. A central processing system is constituted by the CPU 25, a ROM 31 for storing programs for operating the CPU 25, and a RAM 32 for storing/editing various types of information.

This arrangement of the second embodiment is the same as that shown in FIG. 1 except for the multiplexer 34.

Note that the light-emitting device 21-1 and the light-receiving device 22-1, and the light-emitting device 21-2 and the light-receiving device 22-2 are arranged as pairs to oppose each other with a front guide of a feeding table of a press (not shown) therebetween as described above in the explanation of the conventional apparatus. The amplification factors (gains) of the amplifiers 23-1, 23-2, and 27 are arbitrarily adjusted.

An operation of the apparatus having the above arrangement will be described below.

That is, in order to perform overlapping detection of a sheet 33 to be fed, the CPU 25 supplies a light emission signal having the control level $V_{out}$ to the D/A converter 26 beforehand, and an analog signal output from the D/A converter is amplified by the amplifier 27. The amplified signal is supplied to the light-emitting devices 21-1 and 21-2 to cause the light-emitting devices 21-1 and 21-2 to emit light in an optimum light emission amount. The light emitted from the light-emitting devices 21-1 and 21-2 is transmitted through the sheet 33, and the light transmitted through the sheet 33 is received by the light-receiving devices 22-1 and 22-2. When an operator inputs a detection command to the CPU 25 via the keys 28 or a detection command is supplied from the detection timing generator 29 to the CPU 25, the CPU 25 supplies a switching signal SX to the multiplexer 34. On the basis of the supplied switching signal SX, the multiplexer 34 selects the amplified electrical signal obtained via the amplifier 23-1, i.e., the amplified electrical signal corresponding to the received light amount of the light-receiving device 22-1. The selected amplified electrical signal is supplied to the A/D converter 24, converted into a digital signal, and fetched as a light reception signal having the output level $V_{in}$ by the CPU 25. The CPU 25 stores the fetched output level $V_{in}$ as $D_1$ in the RAM 32. On the basis of the supplied switching signal SX, the multiplexer 34 selects the amplified electrical signal obtained via the amplifier 23-2, i.e., the amplified electrical signal corresponding to the received light amount of the light-receiving device 22-2. The CPU 25 stores a light reception signal having the output level $V_{in}$ obtained from the selected amplified electrical signal in the RAM 32 as $D_2$.

The CPU 25 determines a larger one of the output levels $D_1$ and $D_2$ stored in the RAM 32 as $D_H$ and a smaller one, $D_L$, and obtains a difference (level difference) between the output levels $D_H$ and $D_L$. The CPU 25 compares the difference between $D_H$ and $D_L$ with a predetermined value $\Delta d$. In this case, $\Delta d$ is set to be larger than a difference between $D_H$ and $D_L$ obtained by hungry sheets of paper. This $\Delta d$ is obtained by experiments beforehand since it changes in accordance with the characteristics of light-emitting and light-receiving devices to be used. That is, even though the sheet 33 is hungry, if the hungry sheet is an ordinary one, a difference between $D_H$ and $D_L$ always becomes smaller than $\Delta d$ ($D_H - D_L \leqq \Delta d$) provided that the light-emitting devices 21-1 and 21-2 operate normally. If a sheet is extraordinarily hungry, the sheet can be detected and removed.

If one of the light-emitting devices 21-1 and 21-2 fails (burnout of a lamp or degradation), an output level obtained with respect to the faulty light-emitting device is reduced. Therefore, the difference between $D_H$ and $D_L$ becomes larger than $\Delta d$ ($D_H - D_L > \Delta d$).

On the basis of the above concept, if $D_H - D_L \leqq \Delta d$, the CPU 25 determines that the light-emitting devices 21-1 and 21-2 are operating normally and a hungry sheet is an ordinary one. The CPU 25 performs an arithmetic operation represented by the following equation to obtain effective data to be determined Dr:

$$Dr = (D_1 + D_2)/2$$

If $D_H - D_L > \Delta d$, the CPU 25 determines that one of the light-emitting devices 21-1 and 21-2 has failed, removes the smaller output level $D_L$, and sets the remaining output level $D_H$ as the effective data to be determined Dr ($Dr = D_H$).

The CPU 25 compares the effective data to be determined Dr obtained as described above with sheet overlapping detecting determination level Ds. If $Ds > Dr$, the CPU 25 determines that sheets 33 overlap.

That is, in a normal state in which the light-emitting devices 21-1 and 21-2 operate normally and a hungry sheet is an ordinary one, an average value between the output level $D_1$ obtained for the light-emitting device 21-1 and the output level $D_2$ obtained for the light-emitting device 21-2 is set as the effective data to be determined Dr, and the sheet overlapping detecting determination level Ds is properly set. Therefore, even though the sheet 33 is hungry, if the hungry sheet is an ordinary one, overlapping detection can be stably performed. In an abnormal state in which one of the light-emitting devices 21-1 and 21-2 fails, the output level $D_L$ obtained for the faulty light-emitting device is removed, and the output level $D_H$ obtained for a normal light-emitting device is set as the effective data to be determined Dr. Therefore, basic overlapping detection for sheets to be fed is continuously performed to prevent an increase in failure rate of the overlapping detecting apparatus, while a failure rate of the light-emitting and light-receiving devices is increased by using two pairs of devices.

When both the light-emitting devices 21-1 and 21-2 fail, a relation of $D_H - D_L \leqq \Delta d$ is obtained. Therefore, the above relation of Dr is applied to obtain the effective data to be determined Dr, and the overlapping detection operation is not ensured. In this case, however, since the effective data to be determined Dr becomes smaller than the sheet overlapping detecting determination level Ds, overlapping of sheets is constantly determined, resulting in a safe operation.

In the above embodiment, two pairs of light-emitting and light-receiving devices are used. However, even if three or more pairs of devices are used, overlapping detection can be stably performed by similar processing. Note that a system using two pairs of light-emitting and light-receiving devices is optimum in terms of cost and effect.

A processing method to be executed when three or more pairs of light-emitting and light-receiving devices are to be used will be described in detail below. Assuming that the number of pairs is N, that a maximum level of N output levels $D_1$ to $D_N$ obtained for N pairs of light-emitting and light-receiving devices is $D_H$, and that their minimum level is $D_L$, a difference between the maximum and minimum levels $D_H$ and $D_L$ is obtained. If the level difference is equal to or smaller than $\Delta d$ ($D_H - D_L \leqq \Delta d$), it is determined that a hungry sheet is an ordinary one and the N pairs of light-emitting and light-receiving devices operate normally, and an arithmetic operation represented by the following equation (2) is performed to obtain effective data to be determined Dr:

$$Dr=(D_1+D_2+\ldots+D_{N-1}+D_N)/N$$

If the level difference is larger than Δd ($D_H-D_L>\Delta d$), it is determined that at least one of N pairs of light-emitting and light-receiving devices fails, minimum levels $D_L$ at which differences between the maximum level $D_H$ and the minimum level $D_L$ of the N output levels $D_1$ and $D_N$ are equal to or smaller than Δd are removed, and an average value of the remaining output levels is set as the effective data to be determined Dr. Therefore, if the N pairs of light-emitting and light-receiving devices fail except for only one pair of light-emitting and light-receiving devices, an output level for the remaining light-emitting and light-receiving devices is set as the effective data to be determined Dr.

In the above embodiment, when the difference between the maximum level $D_H$ and the minimum level $D_L$ is larger than the predetermined value, minimum levels $D_L$ at which the differences between the maximum level $D_H$ and the minimum level $D_L$ of the N output levels $D_1$ to $D_N$ are equal to or smaller than Δd are removed, and an average value of the remaining output levels is set as the effective data to be determined Dr. However, this processing may be modified such that the maximum level $D_H$ is extracted to obtain a difference between the maximum level $D_H$ and each of the output levels $D_1$ to $D_N$ and an average value of output levels having level differences equal to or smaller than Δd is set as the effective data to be determined Dr.

Figure 7:
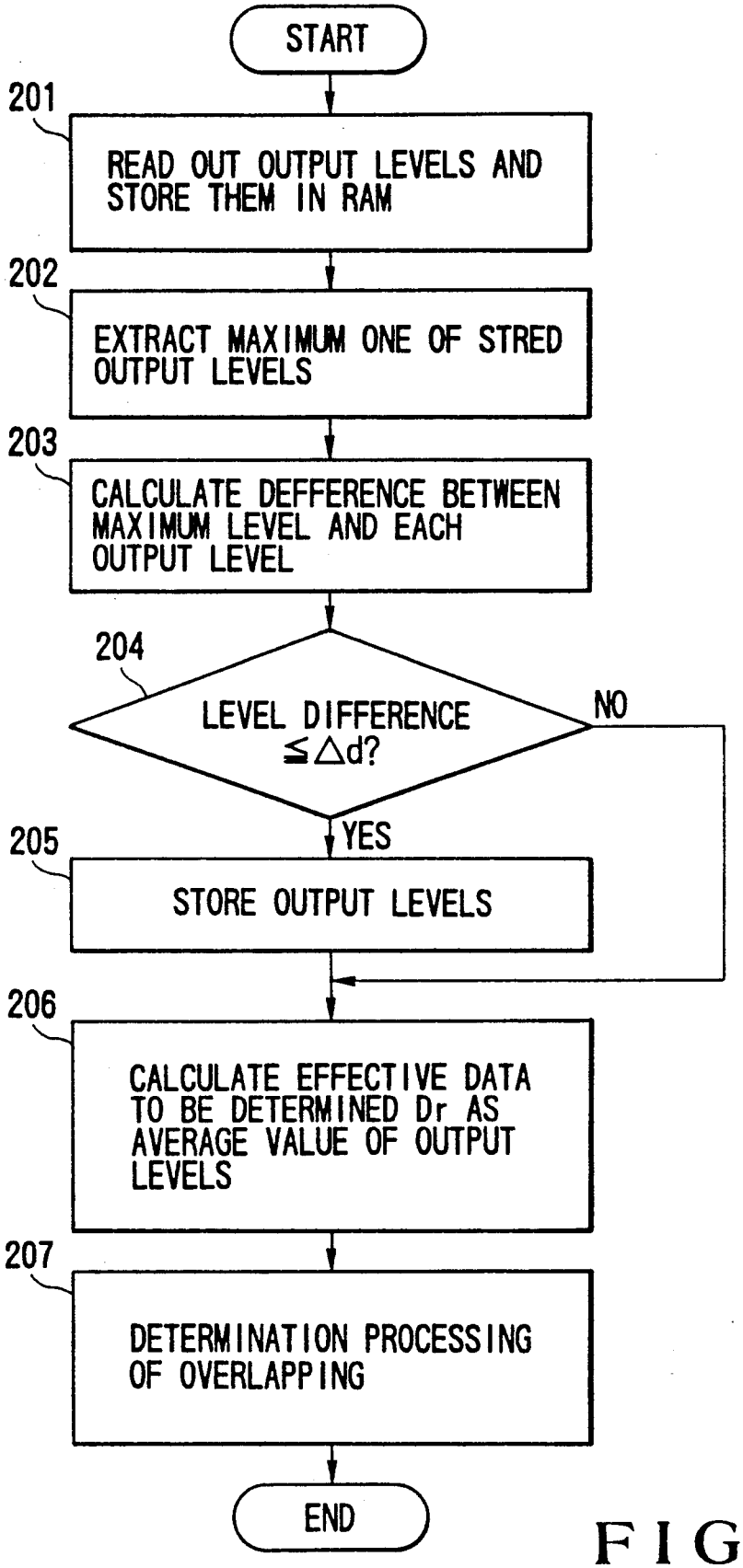
FIG. 7 is a flow chart for explaining processing for obtaining effective data to be determined Dr in the apparatus shown in FIG. 6.
Figure 3:
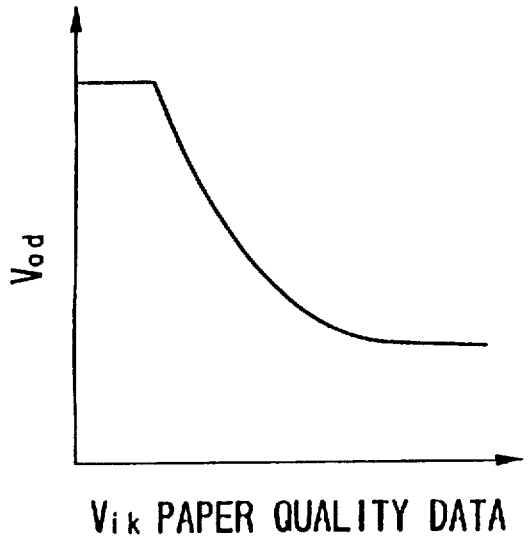
Figure 4:
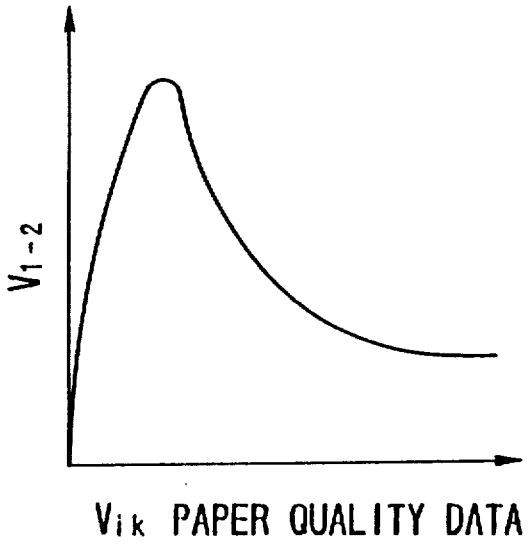
Figure 5:
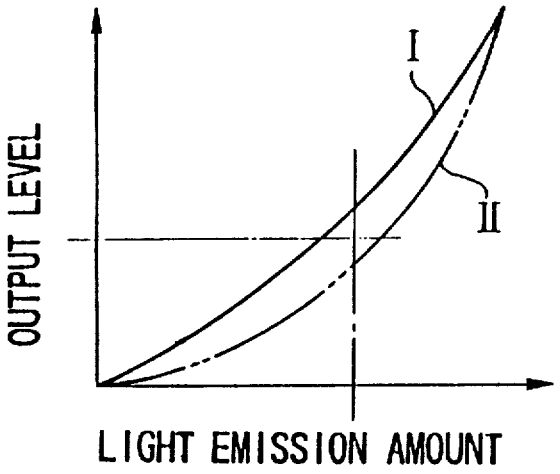
Figure 7:
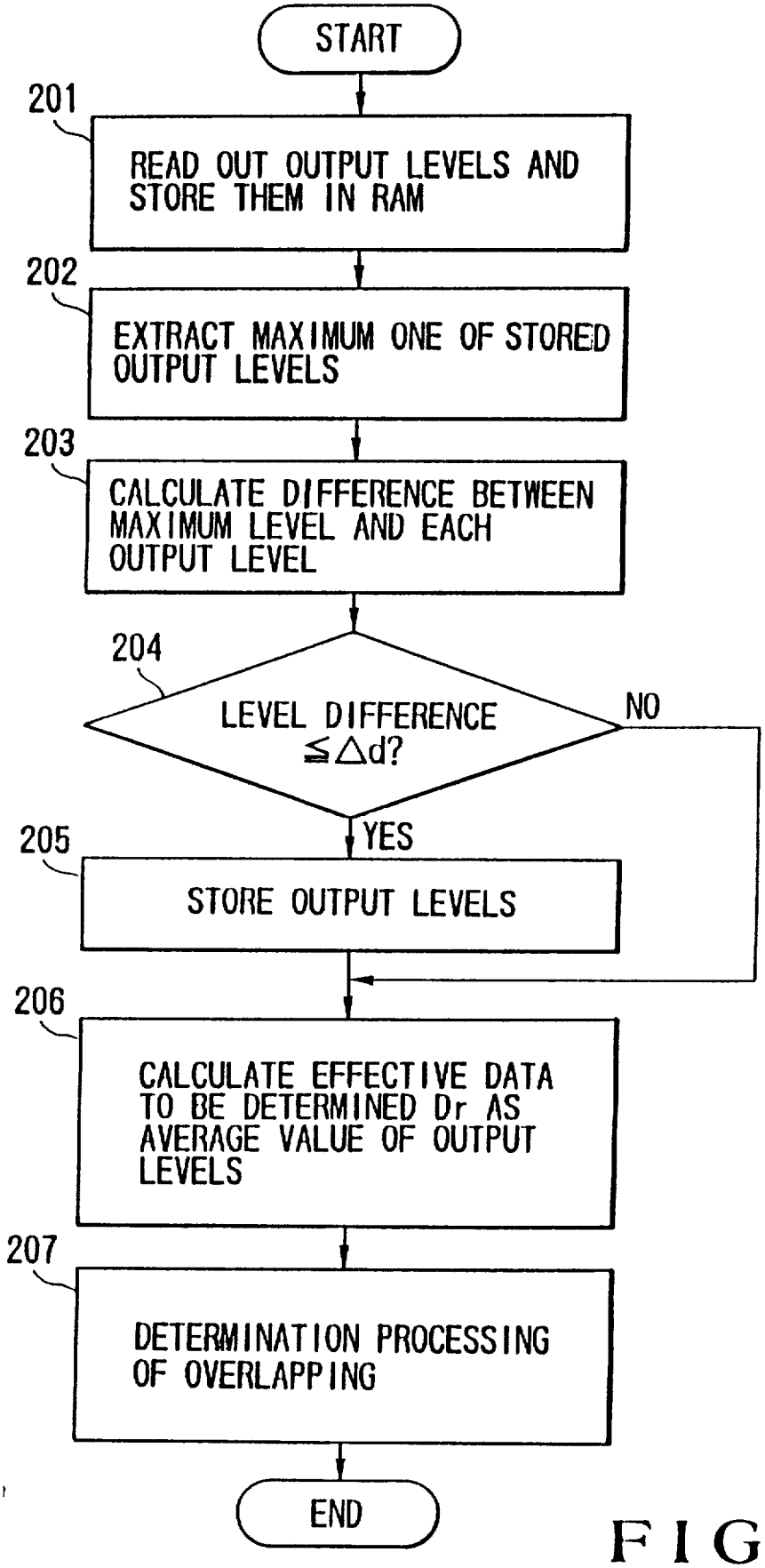

FIG. 7 is a flow chart for explaining the above processing. Referring to FIG. 7, the output levels $D_1$ to $D_N$ are read out and stored in step 201. The maximum level $D_H$ is extracted form the stored output levels (step 202), and a difference (level difference) between the maximum level $D_H$ and each of the output levels $D_1$ to $D_N$ is calculated (step 203). It is checked whether each calculated level difference is equal to or smaller than Δd (step 204), output levels having level differences equal to or smaller than Δd are stored (step 205), and an average value of the stored output levels is set as the effective data to be determined Dr (step 206). That is, an average value of output levels having differences with respect to the maximum level $D_H$ equal to or smaller than Δd is set as the effective data to be determined Dr, and overlapping detection of sheets to be fed is performed on the basis of a comparison result between the effective data to be determined Dr and the determination level Ds (step 207).

In each of the above embodiments, overlapping detection is performed for sheets to be fed to a press. However, the present invention is not limited to the above embodiments but can be practiced in various types of apparatuses requiring overlapping detection of sheets to be fed.

As has been described above, according to the present invention, on the basis of the level value $V_{ik}$ of a light reception signal corresponding to the predetermined level value $V_{os}$ of a light emission signal, the optimum value $V_{od}$ and the change value $V_{1-2}$ are calculated in accordance with the $V_{ik}-V_{od}$ characteristic table and the $V_{ik}-V_{1-2}$ characteristic table, respectively, and the value $V_1$ of the light reception signal corresponding to the optimum value $V_{od}$ of the light emission signal is calculated, thereby calculating the determination level $V_L$ in accordance with $(V_1-V_{1-2}/2)$. Therefore, since the optimum light emission amount and the optimum determination level can be determined with respect to sheets of paper having a wide range of paper quality, stable sheet overlapping detection can be performed with high precision. In addition, since the optimum light emission amount and the optimum determination level can be adjusted without depending on the skills of an operator, an adjustment operation can be largely simplified.

In addition, according to the present invention, a level difference between output levels from two light-receiving devices is compared with a predetermined value. If the level difference is equal to or smaller than the predetermined value, a ½ value of a sum of the two output levels is set as a determination level. If the level difference is larger than the predetermined value, a larger one of the two output levels is set as the determination level. Furthermore, of output levels from N light-receiving means, an average of output levels having level differences with respect to a maximum output level equal to or smaller than a predetermined value is set as the determination level. Therefore, stable overlapping detection can be performed for a hungry sheet of paper. In addition, even though one or more light-emitting devices fail, overlapping detection of sheets to be fed can be performed if at least one pair of light-emitting and light-receiving devices operate normally, thereby preventing an increase in failure rate of the overlapping detecting apparatus.

What is claimed is:

1. A sheet overlapping detecting method i which light-emitting means is driven in accordance with a light emission signal having a control level $V_{out}$ output from a data processing unit, light emitted from said light-emitting means is radiated in a direction of thickness of a sheet to be fed, light transmitted through the sheet to be fed is received by light-receiving means which generates a light reception signal having an output level $V_{in}$ corresponding to a received light amount of said light-receiving means, the output level $V_{in}$ is input to said data processing unit, and overlapping of sheets to be fed is detected on the basis of the light reception signal, said sheet overlapping detecting method comprising the steps of:

setting a predetermined level value $V_{os}$ as the level of said light emission signal, and calculating, on the basis of said light reception signal having a value $V_{ik}$ obtained in response to said light emission signal having said predetermined level value $V_{os}$, an optimum value $V_{od}$ corresponding to the input value $V_{ik}$ in accordance with a $V_{ik}-V_{od}$ characteristic table stored beforehand and representing a relationship between the value $V_{ik}$ as paper quality data and said optimum value $V_{od}$ of the light emission signal;

setting the calculated optimum valve $V_{od}$ as said level of said light emission signal to drive said light-emitting device, and calculating, on the basis of a value $V_{ik}$ of a corresponding light reception signal, a change value $V_{1-2}$ corresponding to the input value $V_{ik}$ in accordance with a $V_{ik}-V_{1-2}$ characteristic table stored beforehand and representing a relationship between the value $V_{ik}$ as the paper quality data and a level change value $V_{1-2}$ of said light reception signal caused by overlapping of sheets to be fed when the optimum value $V_{od}$ is set as the level of said light emission signal;

calculating a determination level $V_L$ in accordance with the following equation:

$$V_L = V_1 - [V_{1-2} \cdot \tfrac{1}{2}](V_{1-2})/2$$

where $V_1$ is the value of a light reception signal obtained when the optimum value $V_{od}$ is set as the level of a light emission signal; and detecting overlapping of sheets to be fed in accordance with the calculated determination level $V_L$.

2. A method according to claim 1, wherein said $V_{ik}-V_{od}$ characteristic table and said $V_{ik}-V_{1-2}$ characteristic table are stored in a ROM.

3. A method according to claim 1, wherein said data processing unit comprises a microprocessor.

4. A sheet overlapping detecting method comprising the steps of:

radiating light emitted from first and second light-emitting means in a direction of thickness of a sheet to be fed;

receiving light transmitted through said sheet to be fed by first and second light-receiving means;

calculating a level difference between first and second output levels corresponding to received light amounts, and comparing the calculated level difference with a predetermined value;

calculating a sum of said first and second output levels if said level difference is equal to or smaller than said predetermined value, and setting a $\frac{1}{2}$ value of said sum as effective data to be determined;

setting a level value of a larger one of said first and second output levels as the effective data to be determined if said level difference is larger than said predetermined value; and comparing the effective data to be determined with a predetermined determination level, and detecting overlapping of sheets to be fed on the basis of the comparison result.

5. A sheet overlapping detecting method comprising the steps of:

radiating light emitted from first to Nth light-emitting means in a direction of thickness of a sheet to be fed;

causing first to Nth light-receiving means to receive light transmitted through said sheet to be fed;

setting an average of output levels, of first to Nth output levels corresponding to received light amounts, having differences with respect to a maximum level equal to or smaller than a predetermined value as effective data to be determined;

comparing a predetermined determination level with said effective data to be determined, and detecting overlapping of sheets to be fed on the basis of the comparison result.

* * * * *

UNITED STATES PATENT AND TRADEMARK OFFICE

CERTIFICATE OF CORRECTION

PATENT NO. : 5,185,520

DATED : February 9, 1993

INVENTOR(S) : Kurata

Figure 5:
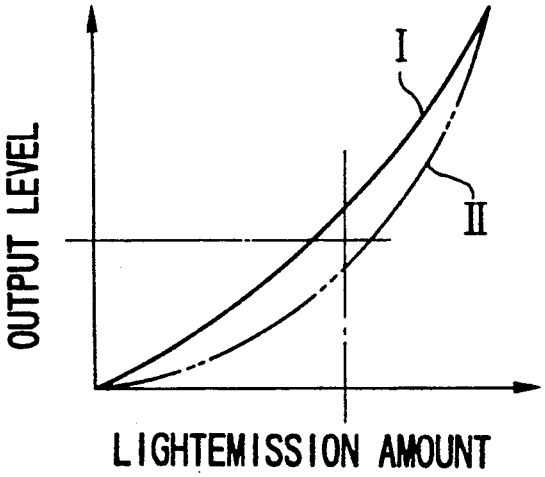
FIG. 5 is a graph showing a relationship between a light emission amount and an output level, which is different for one sheet of paper and two sheets of paper.

It is certified that error appears in the above-indentified patent and that said Letters Patent is hereby corrected as shown below:

In the Drawings, Figures 5 and 7 should appear as shown on the attached pages.

UNITED STATES PATENT AND TRADEMARK OFFICE

CERTIFICATE OF CORRECTION

PATENT NO. : 5,185,520

DATED : February 9, 1993

INVENTOR(S) : Kurata

It is certified that error appears in the above-identified patent and that said Letters Patent is hereby corrected as shown below:

Abstract, line 8, delete "$V_k$" and insert ---- $V_{ik}$ ----.

Column 1, line 40, delete "the", second occurrence.

Column 4, line 6, after "according" insert ---- to ----.

Column 4, line 44, after "the" insert ---- flow chart shown in Fig. 2. That is, when an operator ----.

Column 9, line 37, delete "form" and insert ---- from ----.

Column 10, line 33, delete "i" and insert ---- in ----.

Column 10, line 58, delete "valve" and insert ---- value ----.

Column 11, line 5, delete "$V_L=V_1-[V_{1-2}\cdot 1/2](V_{1-2})^{1/2}$" and insert ---- $V_L=V_1-(V_{1-2})^{1/2}$ ----.

Signed and Sealed this

Twenty-sixth Day of April, 1994

Bruce Lehman

BRUCE LEHMAN

*Commissioner of Patents and Trademarks*

*Attest:*

*Attesting Officer*